US006845513B2

(12) United States Patent
Field et al.

(10) Patent No.: US 6,845,513 B2
(45) Date of Patent: Jan. 25, 2005

(54) BALLISTIC BODY ARMOR EMPLOYING COMBINATION OF DESICCANT AND BALLISTIC MATERIAL

(75) Inventors: Bradley J. Field, Kelowna (CA); Bradley J. Ditchfield, Brampton (CA)

(73) Assignee: Pacific Safety Products Inc., Kelowna (CA)

( * ) Notice: Subject to any disclaimer, the term of this patent is extended or adjusted under 35 U.S.C. 154(b) by 130 days.

(21) Appl. No.: 10/248,975

(22) Filed: Mar. 6, 2003

(65) Prior Publication Data

US 2003/0217402 A1 Nov. 27, 2003

Related U.S. Application Data

(60) Provisional application No. 60/362,067, filed on Mar. 7, 2002.

(51) Int. Cl.[7] ..... F41H 1/02

(52) U.S. Cl. ..... 2/2.5; 2/900; 2/94; 2/244; 428/911; 89/36.05

(58) Field of Search ..... 2/2.5, 94, 244, 2/900; 428/911, 15–20, 22, 27, 919, 114, 115, 119, 120, 187, 189, 190; 89/36.05

(56) References Cited

U.S. PATENT DOCUMENTS

| | | | | | |
|---|---|---|---|---|---|
| 4,287,607 | A | * | 9/1981 | Leach | 2/2.5 |
| 4,413,357 | A | * | 11/1983 | Sacks | 2/2.5 |
| 5,113,666 | A | | 5/1992 | Parrish et al. | |
| 5,289,695 | A | | 3/1994 | Parrish et al. | |
| 5,327,811 | A | | 7/1994 | Price et al. | |
| 5,331,683 | A | * | 7/1994 | Stone et al. | 2/2.5 |
| 5,373,582 | A | * | 12/1994 | Dragone et al. | 2/2.5 |
| 5,471,906 | A | * | 12/1995 | Bachner et al. | 89/36.05 |
| 5,472,769 | A | | 12/1995 | Goerz, Jr. et al. | |
| 5,960,470 | A | * | 10/1999 | Bachner, Jr. | 2/2.5 |
| 5,996,115 | A | * | 12/1999 | Mazelsky | 2/2.5 |
| 6,044,498 | A | | 4/2000 | Schumann et al. | |
| 6,138,277 | A | | 10/2000 | Gillen et al. | |
| 6,233,737 | B1 | | 5/2001 | Ditchfield et al. | |
| 6,562,435 | B1 | * | 5/2003 | Brillhart et al. | 428/105 |
| 6,656,570 | B1 | * | 12/2003 | Fels et al. | 428/155 |

FOREIGN PATENT DOCUMENTS

| | | |
|---|---|---|
| EP | 1134074 A1 | 9/2001 |
| KR | 9932465 A | 8/1999 |
| WO | PCT/US00/02243 | 1/2000 |

OTHER PUBLICATIONS

Celanese Acetate, Microsafe, copyright 1988, www.fabric-link.com.*

* cited by examiner

*Primary Examiner*—John C. Calvert
*Assistant Examiner*—Robert H. Muromoto, Jr.
(74) *Attorney, Agent, or Firm*—Antony C. Edwards

(57) ABSTRACT

A ballistic body armor and dehumidification system includes a flexible carrier containing a watertight sealed pouch which itself contains a desiccant and a stack of substantially vertical layers of ballistic material whose performance degrades under certain conditions in the presence of moisture. The watertight sealed pouch is mounted into the carrier so as to cover a portion of a user's body. The desiccant is mounted into the pouch so that either it is, or its effect is, distributed uniformly across the ballistic material to uniformly reduce the humidity level within the pouch.

18 Claims, 2 Drawing Sheets

BALLISTIC BODY ARMOR EMPLOYING COMBINATION OF DESICCANT AND BALLISTIC MATERIAL

CROSS REFERENCE TO RELATED APPLICATIONS

This application claims priority from U.S. Provisional Patent Application No. 60/362,067 filed Mar. 7, 2002 entitled Combination desiccant and Ballistic Material in Ballistic Body Armor.

BACKGROUND OF INVENTION

This invention relates to the field of body armor and in particular to the use of a desiccant in combination with the ballistic material of body armor in order to maintain humidity in the body armor beneath performance reducing levels.

P-phenylene-2,6-benzobisoxazole, referred to herein and by one manufacturer, Toyobo Co., Ltd. of Osaka, Japan, by the acronym PBO and sold by that manufacturer under the trademark Zylon, is advertised as a rigid-rod lyotropic liquid crystal polymer having tensile strength and modulus superior to P-Aramid fibres, and as exhibiting outstanding high flame resistance and thermal stability among organic fibres. In applicant's experience, use of Zylon™ in ballistic body armor may provide up to approximately thirty percent better performance as compared to, for example, older aramid ballistic materials. Zylon™ is thus now a commonly used ballistic material in body armor design because of its improved performance to protect against penetration by ballistic projectiles such as bullets. However, it is now been identified that Zylon™ degrades under combined high heat and high humidity conditions so as to adversely affect its ballistic performance. The degradation is not, as far as applicant is aware, the impermanent performance degradation such as has been previously identified due to moisture in the use Kevlar™ woven aramid fibre cloth, but rather results in permanent degradation of the ballistic material performance. In applicant's experience, and in applicant's prior art designs such as sold by Pacific Safety Products of Kelowna, British Columbia, Canada, applicant and other designers of ballistic armor take extreme care in the design of, and rigorously test, any changes to the order, number and composition of the layers of material found with ballistic body armor. A user's life may depend on it. Consequently, the introduction by a person skilled in the art of flexible ballistic body armor of a substance or layer into the ballistic material layers which is foreign to conventional substances or layers conventionally found in ballistic body armor is in applicant's experience rarely done. Changes and modifications are only very conservatively implemented to avoid chances of unforeseen adverse consequences to the ballistic performance of the layers of ballistic material whether they be woven aramid fibre layers or the PBO layers which are the subject of the present invention. Applicant's invention is thus unconventional in that at least one layer of a foreign desiccant substance, for example at least one layer of desiccant sheet is interleaved, sandwiching, or sandwiched between the layers of conventional PBO ballistic material in flexible ballistic body armor. It is an object of the present invention to introduce a desiccant into ballistic body armor employing PBO fibre ballistic body armor so as to inhibit permanent performance degradation of the material's ballistic penetration resistance due to moisture within the body armor. In the prior art, applicant is aware of patents disclosing the use of moisture control materials in protective clothing for the purposes of the comfort of the wearer. In particular, applicant is aware of patents which disclose the use of wicking and other materials to transfer, evaporate or absorb moisture within the garment, as for example found disclosed in U.S. Pat. No. 6,044,498 which issued to Schumann et al. on Apr. 4, 2000 for Slash and Cut Resistant Garments for Protecting a Person From Injury, U.S. Pat. No. 5,471,906 which issued Bachner, Jr. et al. on Dec. 5, 1995 for a Body Armor Cover and Method for Making the Same, U.S. Pat. No. 5,327,811 which issued to Price et al. on Jul. 12, 1994 for a Lightweight Ballistic Protective Device, U.S. Pat. No. 5,472,769 which issued to Goerz, Jr. et al. on Dec. 5, 1995 for a Soft Body Armor Material with Enhanced Puncture Resistance Comprising at Least One Continuous Fabric Having Knit Portions and Integrally Woven Hinge Portions, U.S. Pat. No. 6,233,737 which issued to Ditchfield et al. on May 22, 2001 for a Concealable Ballistic Vest and U.S. Pat. No. 6,138,277 which issued to Gillen et al. on Oct. 31, 2000 for a Protective Body Vest. The moisture control in this prior art generally involves the use of fabric layers for example the moisture absorbing inner layer of Goerz, Jr., or the vapour permeable cover layer over the flexible armor plating layer of Bachner, Jr. et al. Similarly, in the prior art applicant is also aware of a Korean Patent, Patent No. KR 2001017116 which issued to Lee for a Bulletproof Vest Having Air Ventilation Property and which discloses the use within a bulletproof vest of inner covers of foamed polyethylene material providing such an air ventilation property so that sweat moisture is transferred from the body of the user to a moisture absorbing fibre positioned inside an outer cover.

SUMMARY OF INVENTION

The present invention is ballistic body armor wherein sheets of ballistic material such as PBO are contained in a layered stack within a sealed watertight pouch mounted or mountable into a flexible carrier for wear by a user. The pouch is sealed so that whatever ambient humidity is introduced into the pouch during manufacturing remains the maximum ambient humidity. A desiccant and desiccant storage means, for example desiccant impregnated sheets of paper, are contained within the pouch. The desiccant sheets may form inter-leaved layers within the stack of layers of ballistic material or may sandwich the stack, or may be a single sheet which may be sandwiched within the stack or otherwise inserted anywhere into the pouch. The desiccant removes or reduces humidity levels within the pouch to such low levels as to remain below humidity levels which, in combination with high heat, would permanently degrade the performance of PBO fibres making up the layers of ballistic material.

It is intended to be within the scope of the present invention to introduce desiccant by a storage and delivery means, such as a matrix or sheet impregnated with a desiccant chemical composition, into a sealed pouch containing layers of ballistic material such as PBO whose ballistic performance degrades due to high humidity so as to inhibit high humidity induced ballistic performance degradation of the ballistic material within the pouch. The pouch is for mounting into ballistic body armor.

In summary then, the ballistic body armor and dehumidification system according to the present invention includes a flexible carrier for wearing by a user. The carrier contains a watertight sealed pouch. The pouch contains a stack of layers of ballistic material, such as PBO, whose performance degrades under certain conditions in the presence of moisture, and a desiccant. The watertight sealed pouch is mounted into the carrier so as to cover a portion of the user's body when the user is wearing the body armor. When the armor is worn by the user, the stack is a stack of substantially vertical layers of flexible ballistic material mounted into the pouch. The desiccant is mounted into the pouch. Because of the wicking effect or aerating effect of the porous weave of the ballistic material, the desiccant may be placed anywhere within the pouch and its effect is distributed uniformly across the stack, to uniformly reduce a humidity level within the pouch and the stack. The desiccant and the nature of woven ballistic material cooperate so that a small amount, such as a small sheet of a desiccant impregnated flexible matrix simply placed anywhere in the pouch will have a far-reaching dehumidification effect on the conventionally closely compacted stack of layers of ballistic material. The desiccant sheet may be interleaved between layers of the stack or may be partially co-extensive with the layers in the pouch, and/or sandwiched between the stack and a wall of the pouch and may be partially co-extensive with an outermost layer of the stack. The desiccant may be a matrix other than a sheet or may be a plurality of carrier sheets impregnated with a desiccant means such as a desiccant chemical composition, wherein the plurality of sheets are interleaved with or snugly adjacent to the stack, again, for example, at least partially co-extensive with the layers in the stack.

DETAILED DESCRIPTION

Figure 1:
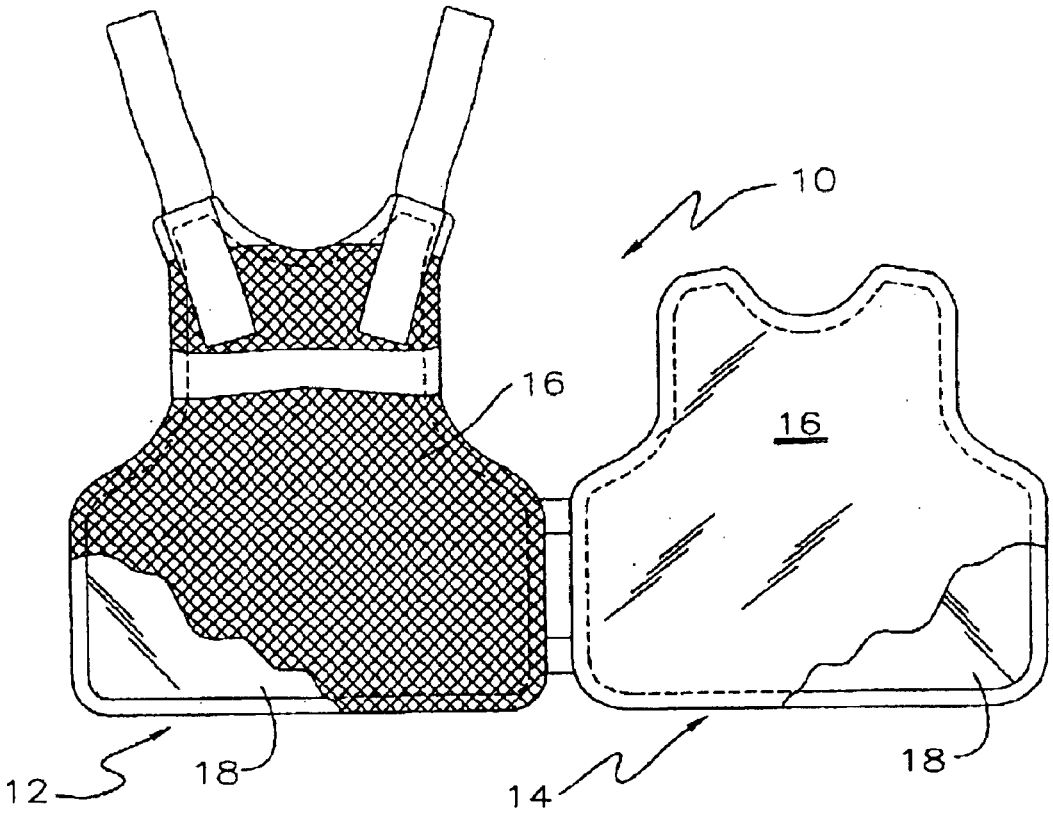
FIG. 1 is, in elevation view, the front and back panel of one form of body armor incorporating the present invention laid flat, the armor casing partially cut away.
Figure 3:
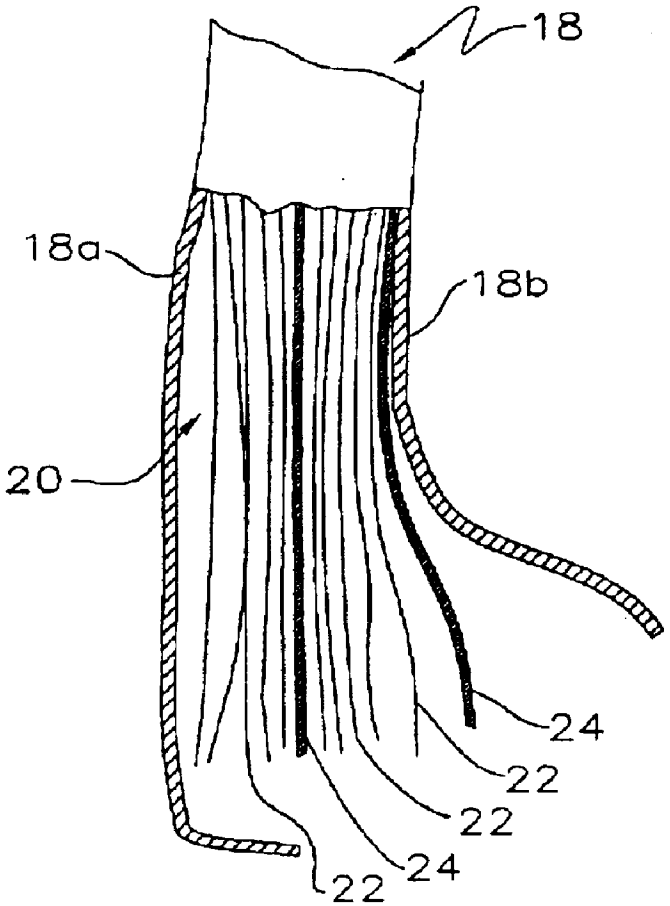
FIG. 3 is a sectional view along line 3—3 in FIG. 2.
Figure 2:
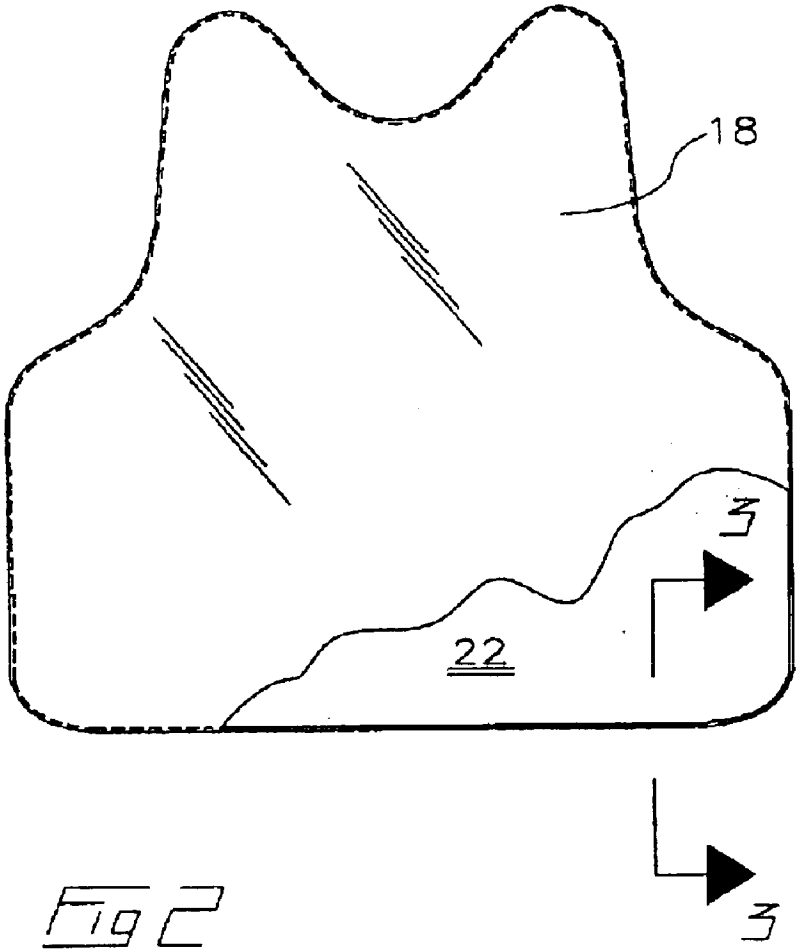
FIG. 2 is, in partially cut away elevation view, a water impervious pouch containing sheets of ballistic material and desiccant for mounting into the body armor of FIG. 1.

With reference to the drawings, wherein similar characters of reference denote corresponding parts in each view, as seen in FIGS. 1–3, ballistic body armor 10 may include front and back panels 12 and 14 respectively. Each of the panels may have an outer fabric casing or carrier 16, for example sewn around the panel's circumferential edges so as to define in combination with the assembled front and back panels, side arm openings and an upper neck opening for the user. Within each of the panels, and retained snugly and conformally so as to correspond to the profiled outline of each panel, is a sealed water impermeable pouch 18, for example, a heat sealed plastic pouch.

Each pouch is sealed contiguously around its perimeter so as to define a cavity 20 within the pouch. The cavity is generally planar when the pouch is laid flat. A stack of adjacently layered generally parallel sheets of Zylon™ PBO fibre material 22 are snugly mounted within pouch 18 so as to maintain sheets 22 generally parallel and compactly sandwiched between front and back faces 18*a* and 18*b* respectively of pouch 18.

Pouch 18 contains at least one flexible sheet 24 impregnated with a desiccant such as Drikette Desiccant Paper, sold by S & D Chemical of Scarborough, Ontario, Canada, and manufactured by Multisorb Technologies Inc. of Buffalo, N.Y., United States. Such desiccant paper may absorb up to three hundred times its weight in moisture. Sheets 24 may be desiccant impregnated paper sheets, but it is not intended to be limiting as many desiccant storage and delivery means would work to introduce the desiccant and uniformly dehumidify a stack of sheets 22 within sealed pouch 18 so as to reduce humidity levels within the pouch. The use of desiccant sheets may provide the advantage of a consistent, structurally stable and uniform distribution of the desiccant across, that is parallel to, at least a portion of the surface area of the pouch which would be exposed to penetration by ballistic projectiles. Uniform distribution of the effect of the desiccant, which remains constantly uniform in cooperation with the wicking or porous nature of the weave of woven ballistic material such as PBO ballistic material offers the advantage of uniform humidity control across the pouch no matter where the desiccant is mounted, so long as exposed to the ballistic material in the pouch, which may be relied on for the operative life of the armor, minimizing the risk of isolated areas of higher humidity within the distributed volume of the cavity within the pouch.

As will be apparent to those skilled in the art in the light of the foregoing disclosure, many alterations and modificaare possible in the practice of this invention without departing from the spirit or scope thereof. Accordingly, the scope of the invention is to be construed in accordance with the substance defined by the following claims.

What is claimed is:

1. Ballistic body armor comprising a flexible carrier for wearing by a user, a watertight sealed pouch mounted into said carrier so as to cover a portion of the user's body, a compacted stack of substantially vertical layers of flexible woven ballistic material mounted into said pouch, a desiccant mounted into said pouch wherein said desiccant reduces a humidity level within said pouch and said compacted stack, wherein said desiccant is at least one desiccant impregnated sheet.

2. The ballistic body armor of claim 1 wherein said ballistic material is PBO.

3. The ballistic body armor of claim 1 wherein said ballistic material is PBO.

4. The ballistic body armor of claim 2 wherein said desiccant is at least one desiccant impregnated sheet.

5. The ballistic body armor of claim 1 wherein said sheet is interleaved between layers of said stack.

6. The ballistic body armor of claim 4 wherein said sheet is interleaved between layers of said stack.

7. The ballistic body armor of claim 1 wherein said sheet is sandwiched between said stack and a wall of said pouch.

8. The ballistic body armor of claim 1 wherein said desiccant is a plurality of sheets impregnated with a desiccant means, and wherein said plurality of sheets are interleaved with or snugly adjacent to said stack.

9. The ballistic body armor of claim 1 wherein said plurality of sheets are co-extensive with said layers in said stack.

10. Ballistic body armor system for reducing humidity in sealed flexible body armor comprising a flexible carrier for wearing by a user, a watertight sealed pouch mountable into said carrier so as to cover a portion of the user's body, a stack of substantially vertical layers of flexible woven ballistic material mountable into said pouch, a desiccant mountable into said pouch distributed uniformly across said stack, wherein said desiccant reduces a humidity level within said pouch and said stack, wherein said desiccant is at least one desiccant impregnated sheet.

11. The ballistic body armor of claim 10 wherein said ballistic material is PBO.

12. The ballistic body armor of claim 11 wherein said ballistic material is PBO.

13. The ballistic body armor of claim 11 wherein said desiccant is at least one desiccant impregnated sheet.

14. The ballistic body armor of claim 11 wherein said sheet when mounted in said stack is interleaved between layers of said stack so as to be co-extensive with said layers in said pouch.

15. The ballistic body armor of claim 13 wherein said sheet is interleaved between layers of said stack so as to be co-extensive with said layers in said pouch.

16. The ballistic body armor of claim 11 wherein said sheet when mounted in said pouch is sandwiched between said stack and a wall of said pouch and is co-extensive with an outermost layer of said stack.

17. The ballistic body armor of claim 10 wherein said desiccant is a plurality of sheets impregnated with a desiccant means, and wherein said plurality of sheets when mounted in said pouch are interleaved with or snugly adjacent to said stack.

18. The ballistic body armor of claim 10 wherein said plurality of sheets when mounted in said pouch are co-extensive with said layers in said stack.

* * * * *